US007134932B1

(12) United States Patent
Carrasco et al.

(10) Patent No.: US 7,134,932 B1
(45) Date of Patent: Nov. 14, 2006

(54) MUSICAL BABY BOTTLE

(76) Inventors: Raymond Carrasco, 6130 Lincoln Ave., South Gate, CA (US) 90280; Maria Carrasco, 6130 Lincoln Ave., South Gate, CA (US) 90280

( * ) Notice: Subject to any disclaimer, the term of this patent is extended or adjusted under 35 U.S.C. 154(b) by 294 days.

(21) Appl. No.: 10/750,729

(22) Filed: Jan. 5, 2004

(51) Int. Cl.
*A63H 33/00* (2006.01)
*A47D 15/00* (2006.01)

(52) U.S. Cl. ..... 446/227; 446/404; 248/102

(58) Field of Classification Search ..... 446/227, 446/74, 297, 302; 248/105, 102; 215/11.1; 84/95.2; 200/61.45 R, 61.52
See application file for complete search history.

(56) References Cited

U.S. PATENT DOCUMENTS 4,415,776 A * 11/1983 Tang et al. ..... 379/101.01
4,678,093 A * 7/1987 Allen ..... 215/11.1
4,817,950 A * 4/1989 Goo ..... 463/36
4,898,060 A 2/1990 To
4,944,704 A 7/1990 Grace
5,664,745 A * 9/1997 Hadaway ..... 248/105
5,672,090 A * 9/1997 Liu ..... 446/268
6,392,556 B1 * 5/2002 Tomich ..... 340/689
6,394,903 B1 * 5/2002 Lam ..... 463/22

FOREIGN PATENT DOCUMENTS

CH 690165 A5 * 5/2000

* cited by examiner

*Primary Examiner*—John H. Hotaling, II
*Assistant Examiner*—Alex F. R. P. Rada, II
(74) *Attorney, Agent, or Firm*—Charles H. Thomas

(57) ABSTRACT

A musical baby bottle is provided with an omnidirectional, gravity-operated switching mechanism for turning a musical player on and off, depending upon the orientation of the bottle. The infant nursing bottle of the invention employs a liquid container and a base containing the electrical switching mechanism releaseably attached to the bottom of the liquid container, such as by a threaded connection. A hollow cavity is defined within the structure of the base. The cavity has an inclined floor that slopes from the periphery of the cavity toward the axial center of the base. A detent recess is located at the axial center of the base and an electrical switch having a switch actuator is located at the detent. A sphere within the cavity rolls by gravity across the inclined surface of the cavity floor. The sphere lodges in the detent when the base and liquid container supported upon the base are oriented vertically upright, as when placed upon a horizontal surface. When the base and liquid container are tilted, as when feeding a baby the sphere dislodges from the detent thereby closing a circuit from a battery to the music player to play a lullaby or other calming music.

5 Claims, 4 Drawing Sheets

MUSICAL BABY BOTTLE

BACKGROUND OF THE INVENTION

1. Field of the Invention

The present invention relates to a baby bottle containing a music player that is operated by omnidirectional tilting of the bottle from vertical alignment.

2. Description of the Prior Art

Baby bottles have been in continuous use for many, many years for nursing and feeding liquids to infant children. Conventional baby bottles are formed as elongated, tubular containers of glass or plastic having a closed bottom end and an open mouth at the opposite, top end. Rubber nipples are releaseably secured to the open, top ends of conventional bottles by means of annular plastic collars which provide a liquid-tight seal at the mouth of the bottle. Conventional infant feeding bottles of this type may be cylindrical in cross-sectional shape, but are sometimes formed with a polygonal outer cross-sectional configuration.

Infant children are often quite temperamental during feeding. The distress of many infants during feeding may be relieved by playing soothing music to the infant. In many cases music relaxes and calms the child so that the infant is able to take nourishment by sucking liquid from the bottle through the nipple without agitation.

The soothing and calming effect of music has been used to advantage in a wide variety of children's products. Stuffed animals, mobiles, and dolls have all been manufactured with internal music boxes designed to capture and hold the attention of infant children and newborn babies.

Various liquid containers for feeding infants have been devised that contain music players for providing soothing music to calm a distressed infant. Prior systems of this type are described, for example, in U.S. Pat. Nos. 4,678,093; 4,898,060; 4,944,704; and 5,664,745. Most of these prior art devices are dependent upon manual operation to close an electrical connection to a music player to turn the music player on or off. Some of these prior art devices are actuated by a switch that closes when the infant feeding bottle is lifted from a supporting surface.

Only one of the use prior art devices, specifically that described in U.S. Pat. No. 4,678,093, involves an electrical switching system that is actuated by tilting of the bottle. However, this system employs a plurality of mercury switches. While the switches are alternatively closed by tilting the bottle in certain directions, this system does not provide for omnidirectional operation. Furthermore, this system carries with it the risk of exposure to mercury, which represents a serious hazzard to the health of the infant and others.

SUMMARY OF THE INVENTION

The present invention provides a baby bottle with music playing capabilities in which the music player may be actuated by omnidirectional tilting of the bottle. Furthermore, the present invention involves a novel system of actuation by tilting the bottle that totally avoids the use of any hazardous substance.

The infant feeding bottle of the present invention softly plays music such as a lullaby. The music is provided by a small musical chip, such as those featured in greeting cards. The digitally programmed chip is powered by a small battery and provides an audio output through a small speaker. All of these electrical components are located in a base that is releaseably attached to an elongated, tubular liquid feeding container of the type described above.

Unlike other infant feeding container systems that play music, the musical baby bottle of the present invention has a cavity in the base with a sloped floor leading to a detent recess, which may be a dimple at the axial center of the base. A small, relatively heavy sphere such as a ball bearing or marble is located in the cavity. The floor of the cavity is inclined from the periphery of the cavity away from the bottom of the liquid container and toward the axial center of the base where the detent is located. The sloped incline of the cavity floor should not be so shallow that the sphere will roll out of the detent due to a slight agitation of the liquid container. On the other hand, inclination should not be so steep that the sphere will remain lodged in the detent unless the liquid container is tilted so far that the closed bottom of the container is above its top. Preferably, the floor of the cavity is inclined an angle of at least two degrees but no greater than ten degrees to allow the sphere to roll back easily into the detent when the liquid container is placed in an upright, vertical orientation.

The base in which the electrical components of the invention are located preferably has a generally disk-shaped outer configuration with an internally threaded annular screw connection at its top end that receives corresponding threads depending from the periphery of the bottom of a liquid container. When the base and the bottom of the liquid container are screwed together, they reside in coaxial alignment. When the axis of alignment of the base and liquid container is vertical, the sphere lodges in the detent and opens a dynamically actuated switch to cut off electrical power to the music player. On the other hand, when the liquid container, together with its attached base are tilted, as occurs during feeding of an infant, the sphere rolls out of the detent and across the inclined surface of the floor of the cavity to allow the dynamic switch to close. The battery thereupon powers the music player to play a lullaby or other soft music to the feeding infant.

In one broad aspect the present invention may be considered to be an improvement in a musical infant nursing bottle employing a liquid container, an electrical power source, and a music player. The improvement of the invention is comprised of an omnidirectional, gravity-operated switching mechanism including an inclined surface with a detent recess therein, an electrical switch having a switch actuator located at the detent, and a sphere movable by gravity to roll across the inclined surface. The sphere is releaseably engageable in the detent recess, whereby the sphere operates the switch actuator when lodged in the detent recess to create an open circuit condition between the electrical power source and the musical player.

Preferably the inclined surface is a floor of a cavity formed beneath the liquid container. The sphere rolls freely across the floor and beneath the liquid container when the liquid container is seated in the base and tilted from vertical alignment to a predetermined extent. For example, the inclination of the floor may be such that the sphere rolls out of the detent when the infant nursing bottle is tilted ten degrees or more from vertical alignment. In one preferred embodiment of the invention the floor is inclined at an angle toward the detent recess by no less than about two degrees. That is, the floor is inclined at an angle of no less than about two degrees relative to a plane perpendicular to the longitudinal axis of the liquid feeding container.

Preferably the cavity floor has a circular outer perimeter and an axial center. The floor slopes from the outer perimeter away from the bottom of the liquid container and toward the axial center of the cavity. Preferably also the detent recess is formed as a circular aperture of diameter smaller than that of the sphere and located in the floor at the axial center of the cavity. While the surface of the floor may be shaped as a spherical sector, or even hemispherical, it preferably has an upper surface of an inverted, frustoconical shape.

The switch actuator is preferably a depressible button located directly beneath the circular detent recess at the axial center of the floor of the cavity. The music player is preferably an electronically encoded digital chip with a speaker electrically coupled thereto.

In preferred embodiments of the invention the musical infant nursing bottle is provided with a bypass circuit around the dynamic, gravity-operated switching mechanism. The bypass circuit couples the electrical power source to the music player and has an externally accessible, manually operated bypass switch. The bypass switch is used for manually turning the music player off and alternatively manually turning the music player on irrespective of the location of the sphere within the cavity in the base.

The base preferably encapsulates the electrical power source, the musical player, and the omnidirectional, gravity-operated switching mechanism. Also, the base is preferably detachably coupled to the liquid container. The base defines within its structure a cavity having a ceiling located beneath the liquid container. The inclined surface is a floor of the cavity spaced beneath the ceiling a distance greater than the diameter of the sphere.

In a more specific aspect the invention may be considered to be a musical apparatus for feeding liquid to a baby comprising: a tubular liquid container, a base defining a cavity having a floor with a detent recess defined therein, a rigid sphere located within the cavity and atop the floor, a dynamic electrical switch, an electrical power source, and a music player.

The tubular liquid container has an open end with a baby feeding nipple thereon and an opposite closed end. The base has an axial center and forms a liquid container seat to receive and support the closed end of the liquid container from beneath. The base also serves as a stand for supporting the liquid container in an upright vertical orientation.

The cavity defined by the base has a periphery and the floor of the cavity slopes from the periphery away from liquid container toward the axial center of the base. The detent recess in the cavity floor is located at the axial center of the base. The rigid sphere is capable of rolling movement across the floor and lodges in the detent recess in the floor when the stand supports the tubular container in an upright vertical disposition.

The dynamic electrical switch has a depressible switch actuator located directly beneath the detent recess. When the sphere is lodged in the detent recess the weight of the sphere is sufficient to depress the depressible switch actuator. The electrical power source is located in the base. The music player is also located in the base and is electrically connected to the electrical power source through the dynamic, electrical switch such that depression of the depressible switch actuator creates an open circuit condition between the electrical power source and the music player.

The invention may be described with greater clarity and particularity by reference to the accompanying drawings.

DESCRIPTION OF THE EMBODIMENT

Figure 2:
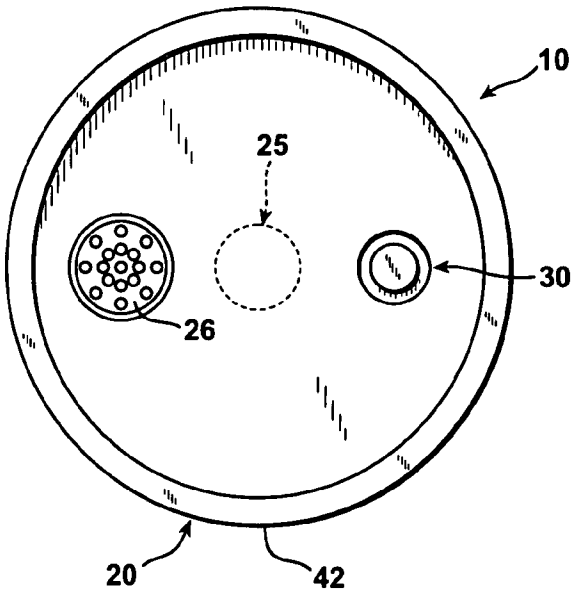
FIG. 2 is a bottom plan view of the musical baby bottle shown in FIG. 1.
Figure 1:
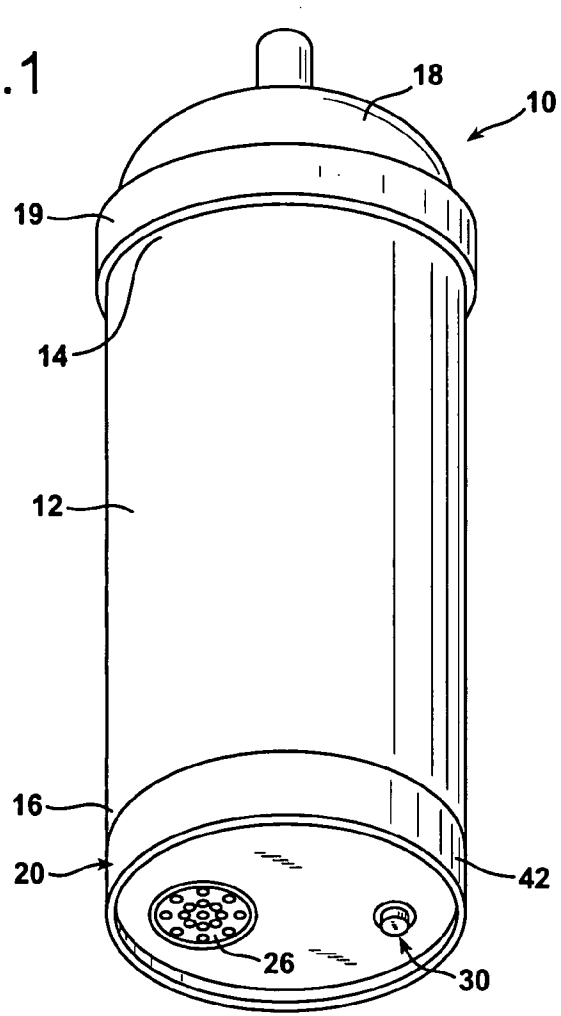
FIG. 1 is a perspective view of a preferred embodiment of a musical baby bottle according to the present invention.

FIG. 1 illustrates a musical baby bottle indicated generally at 10 comprising an elongated, generally cylindrical container 12 having an open top end 14 and a closed bottom end 16. The open top end 14 has a conventional baby feeding nipple 18 releaseably secured thereto by an annular, plastic collar 19.

Figure 3:
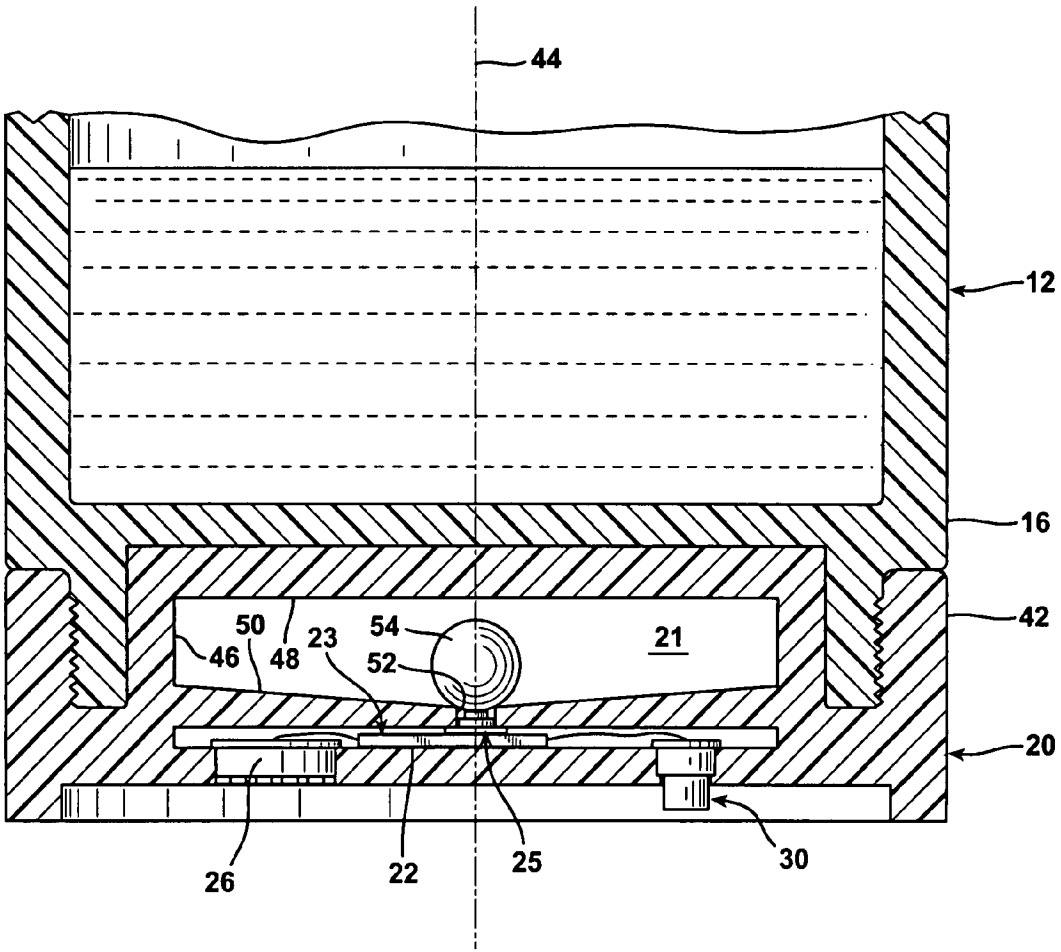
FIG. 3 is a sectional elevational detail of the lower portion of the baby bottle of the invention shown in an upright, vertical orientation.
Figure 4:
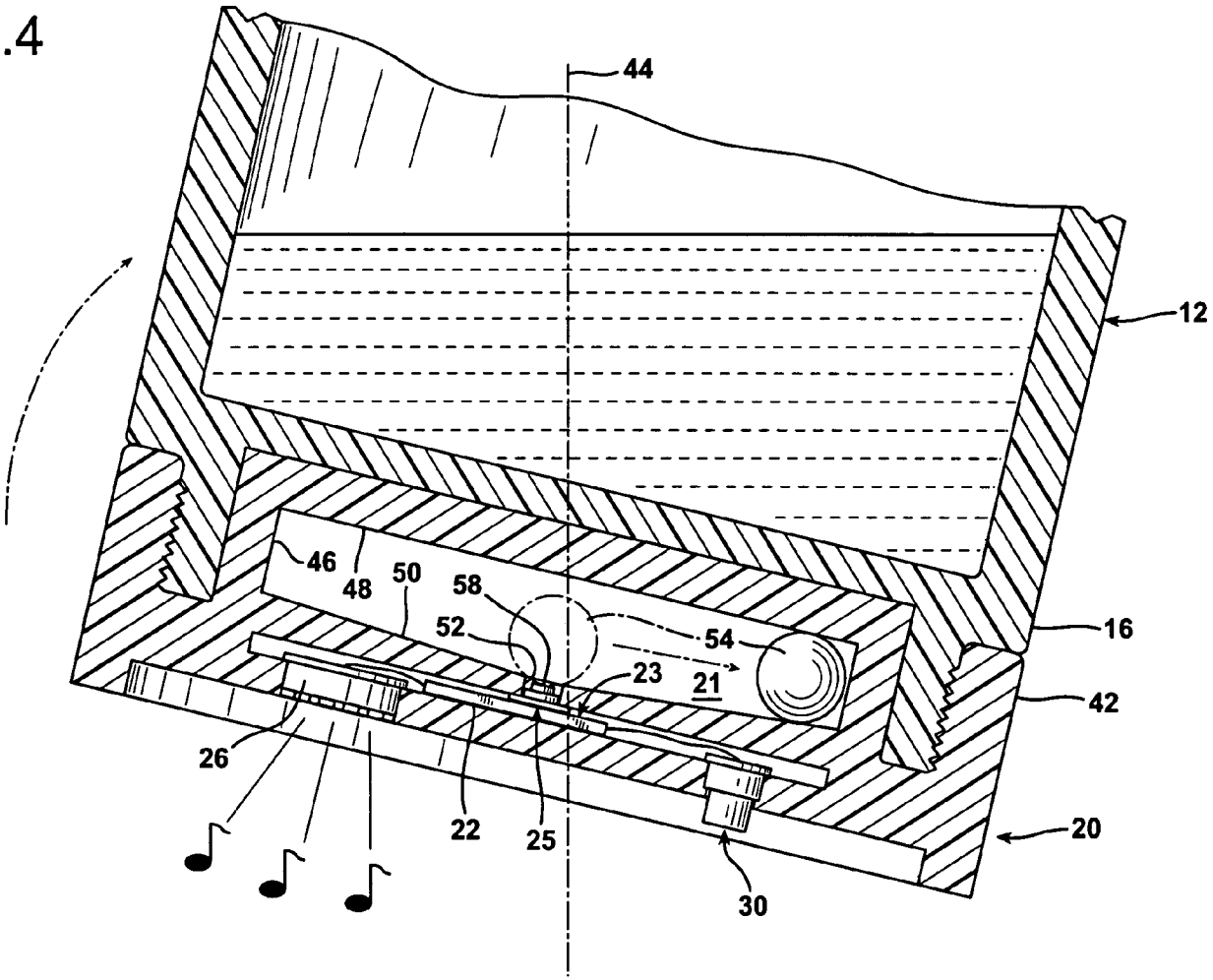
FIG. 4 is a sectional elevational view of the lower portion of the baby bottle of the invention shown in an orientation tilted from vertical alignment, as it would be when feeding an infant.
Figure 5:
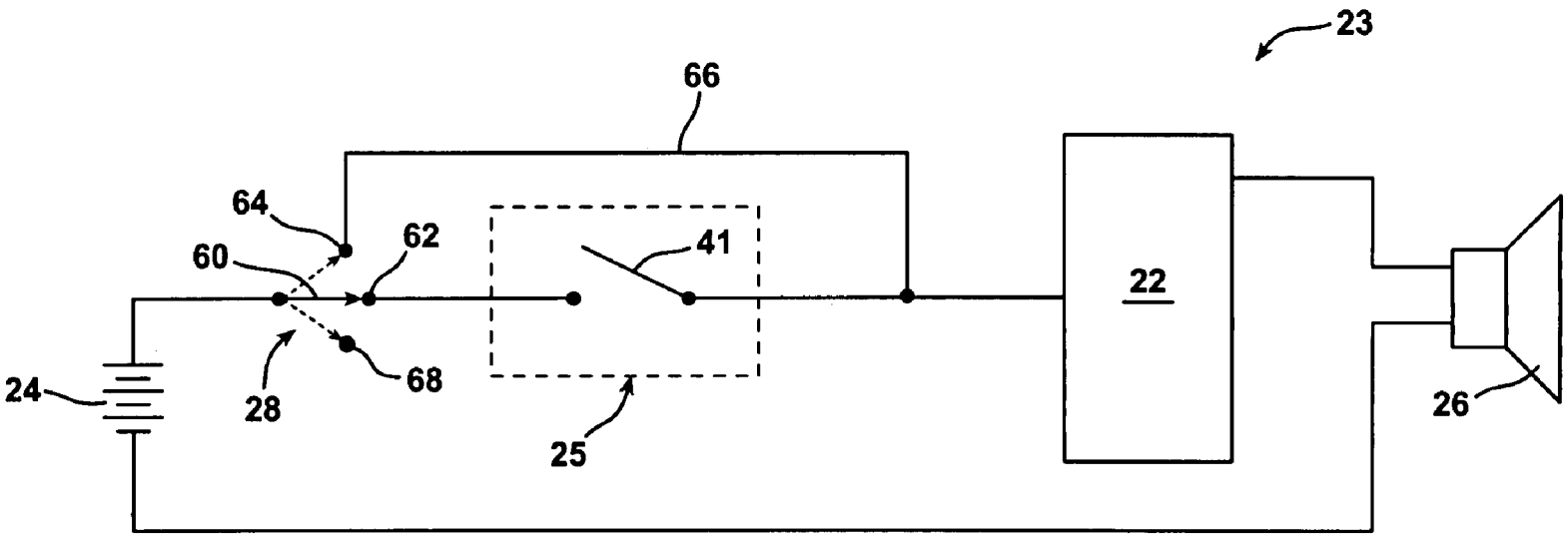
FIG. 5 is an electrical schematic diagram showing the circuitry of the preferred embodiment of the musical baby bottle depicted and described.

The musical baby bottle 10 also includes a hollow, generally disk-shaped base 20 that defines within its structure an enclosed cavity 21, as indicated in FIGS. 3 and 4. Beneath the cavity 21 there is a musical player 23 that includes a digital, preprogrammed electronic chip 22 with an electrical output to an audio speaker 26. The musical player 23 is powered by a small battery 24 disposed within the base 20. The battery 24 provides power to the music player 23 through a depressible, gravity-operated, dynamic switching mechanism including a dynamic electrical switch 25 having a switch actuator with a switch contact 41.

The base 20 is preferably formed of rubber or plastic and encapsulates the battery 24, the music player 23, and the omnidirectional, gravity-operated switching mechanism. The base 20 is detachably coupled to the liquid container 12 by screwing it onto or unscrewing it from an annular threaded engagement ring formed at the bottom end 16 of the liquid container 12.

The baby bottle 10 is also provided with a manual bypass circuit that includes a bypass switch 28. The bypass switch 28 is manually operable by a pushbutton 30 that is exposed at the underside of the base 20. The bypass switch 28 is thereby operable externally of the base 20 to alternatively create a power connection directly from the battery 24 to the music player 23, isolate the battery 24 from the music player 23, and couple the battery 24 to the music player 23 through the dynamic electrical switch 25.

The bottom end 16 of the liquid container 12 includes an annular, externally threaded coupling connector that is threadably engageable with internal threads defined in a cylindrical, annular coupling ring 42 at the outer periphery of the base 20. The base 20 thereby provides a seat for the liquid container 12. The base 20 may be screwed onto the bottom end 16 of the liquid container 12 so as to serve as a stand to support the liquid container 12 in an upright orientation as illustrated in FIG. 3. When it is necessary to wash the liquid container 12, or heat it in a microwave oven, the base 20 is unscrewed from the bottom end 16 of the liquid container 12. The depressible bypass switch 28 is sealed and is coupled with a liquid-tight seal to the bottom of the base 20. The battery 24 is also housed within a watertight chamber within the base 20. The base 20 is formed as a watertight capsule enclosing the cavity 21, which allows it to be washed.

The base 20 has an axial center that lies on the longitudinal axis of alignment 44 of both the liquid container 12 and the base 20 when the base 20 is releaseably coupled to the bottom end 16 of the liquid container 12, as illustrated in the drawing figures. The cavity 21 has a circular periphery within an inner cylindrical, peripheral wall 46 and a flat, circular ceiling 48. The ceiling 48 is located beneath the liquid container 12. The peripheral wall 46 extends downwardly from the circular perimeter of the ceiling 48. From the lower edge of the peripheral wall 46 the floor 50 of the cavity 21 slopes downwardly away from the bottom 16 of the bottle 12 and inwardly at an angle of about two degrees relative to the plane of the ceiling 48 toward a central, circular aperture 52 located at the axial center of the base 20. The circular aperture 52 serves as a detent recess in the cavity floor 50.

A rigid sphere 54 formed as a marble or ball bearing is located within the cavity 21 and is disposed atop the floor 50 for rolling movement thereacross. The diameter of the hard, relatively heavy sphere 54 is less than the height of the peripheral wall 46. Therefore, the surface of the cavity floor 50 is spaced beneath the ceiling 48 a distance greater than the diameter of the sphere 54, even at the peripheral wall 46. The sphere 54 therefore cannot become lodged between the ceiling 48 and the floor 50 at the peripheral wall 46 when the liquid container 12 is tilted on its side, as illustrated in FIG. 4.

On the other hand, when the base 20 and liquid container 12 are oriented in vertical, upright alignment, as when placed upon a horizontal surface, the sphere 54 easily rolls down the inclined surface of the cavity floor 50 and lodges in the detent recess formed by the circular opening 52. The cavity floor 50 has an inverted frustoconical shape. The circular aperture 52 at the center of the floor 50 has a diameter smaller than the diameter of the sphere 54 so that the sphere 54 cannot pass completely through the circular aperture 52. Nevertheless, when the liquid container 12 and its releaseably attached base 20 are oriented in a vertically upright condition as illustrated in FIG. 3, the weight of the sphere 54 depresses the slight upward bias provided by an internal spring located within the dynamic electrical switch 25 against the pressure operated switch actuator button 58 located directly below the circular detent aperture 52. The depression of the switch actuator button 58 closes the dynamic switch contact 41 so that the battery 24 thereupon supplies power to the programmed musical chip 22. The electronically encoded programmed digital chip 22 thereupon provides an output to the audio speaker 26 to audibly play a lullaby or other soothing tune.

Together the inclined floor 50 of the cavity 21 with the detent recess aperture 52 at its axial center and the dynamic electrical switch 25 with its depressible pushbutton 58 and its switch actuator contact 41 form an omnidirectional, gravity-operated switching mechanism. This omnidirectional, gravity-operated switching mechanism is actuated and deactuated by depression and release of the pushbutton 58 depending upon whether or not the sphere 54 rolls to the detent recess formed by the circular aperture 52, as illustrated in FIG. 3, or out of the detent recess formed by the circular aperture 52, as illustrated in FIG. 4.

The bypass switch 28 has a three position wiper 60 that is sequentially advanced by repeated depression of the spring-biased bypass pushbutton 30. Repeated depression of the pushbutton 30 sequentially advances the wiper 60 into electrical contact with the contact node 62 leading to the dynamic switch 25, the contact node 64 connected to the bypass line 66, or the contact node 68, which is an open contact.

When the switch wiper 60 is advanced into electrical contact with the contact node 64, it closes a bypass circuit from the battery 24 around the gravity-operated switching mechanism and couples the electrical power source provided by the battery 24 directly to the music player 23. When the switch wiper 60 is in this position the music player 23 will play music continuously until the switch actuator and wiper 60 is advanced by depression of the pushbutton 30. The exposed pushbutton 30 of the bypass switch 28 is used to manually turn the music player 23 on and off irrespective of the location of the sphere 54 within the cavity 21.

Undoubtedly, numerous variations and modifications of the invention will become readily apparent to those familiar with musical baby bottles. Optimum dimensions of the component parts and the specific components employed may vary, as may the size of electrical and mechanical components, materials used in construction, and electrical switch design. Other variations in shape, form, function, and specific manner of manipulation of component parts, assembly and interaction of those parts and components will become readily apparent to one of ordinary skill in the art. Numerous equivalent structures and operating mechanisms to those illustrated in the drawings will also become readily apparent. Accordingly, the scope of the invention should not be construed as limited to this specific embodiment depicted and described, but rather is defined in the claims appended hereto.

I claim:

1. In a musical infant nursing bottle employing a liquid container, an electrical power source, and a musical player, a base containing said electrical power source and said musical player and forming a liquid container seat to receive and support said liquid container from beneath and also to serve as a stand for supporting said liquid container in an upright vertical orientation, and wherein said base defines within its structure a cavity with a circular outer perimeter and an axial center, the improvement comprising: an omnidirectional, gravity operated switching mechanism including a cavity floor formed within said base as an inverted, frustoconical, inclined surface with a detent recess therein at said axial center of said cavity, and said cavity floor is inclined toward said detent recess at an angle of no less than about two degrees and no greater than about ten degrees, and said floor slopes from said outer perimeter away from said liquid container and toward said axial center at a uniform angle of inclination relative thereto, and further comprising a sphere movable by gravity to roll freely across said floor and beneath said liquid container when said liquid container is tilted from vertical alignment, and said detent recess is a circular aperture of diameter smaller than that of said sphere located in said floor at said axial center of said cavity, wherein said sphere rolls across said inclined surface and releaseably lodges in said detent recess when said liquid container resides in vertical alignment, and an electrical switch having a switching actuator located directly beneath said detent recess, whereby the weight of said sphere operates said switching actuator when said sphere is lodged in said detent recess to create an open circuit condition between said electrical power source and said musical player, and said sphere rolls out of said detent recess to create a closed circuit condition between said electrical power source and said musical player when said base is tilted sufficiently from vertical alignment.

2. A nursing bottle according to claim 1 wherein said musical player is comprised of an electronically encoded digital chip with a speaker coupled thereto.

3. A nursing bottle according to claim 1 further comprising a bypass circuit around said gravity-operated switching mechanism and coupling said electrical power source to said musical player, and said bypass circuit has an externally accessible, manually operated bypass switch for manually turning said musical player off and alternatively turning said musical player on irrespective of the location of said sphere.

4. A nursing bottle according to claim 1 wherein said base is detachably coupled to said liquid container.

5. A musical apparatus according to claim 1 further comprising a manual bypass circuit connecting said electrical power source to said musical player and including a manual bypass switch operable externally of said base to alternatively close an electrical connection directly from said power source to said musical player, isolate said electrical power source from said musical player, and couple said power source to said musical player through said electrical switch.

* * * * *